US011452415B2

(12) United States Patent
Abrahamyan-Smith

(10) Patent No.: US 11,452,415 B2
(45) Date of Patent: Sep. 27, 2022

(54) CEILING FAN CLEANER

(71) Applicant: Anna Abrahamyan-Smith, Las Vegas, NV (US)

(72) Inventor: Anna Abrahamyan-Smith, Las Vegas, NV (US)

( * ) Notice: Subject to any disclaimer, the term of this patent is extended or adjusted under 35 U.S.C. 154(b) by 663 days.

(21) Appl. No.: 16/383,370

(22) Filed: Apr. 12, 2019

(65) Prior Publication Data

US 2019/0313868 A1 Oct. 17, 2019

Related U.S. Application Data

(60) Provisional application No. 62/656,888, filed on Apr. 12, 2018.

(51) Int. Cl.

| | |
|---|---|
| ***A47L 25/00*** | (2006.01) |
| ***A47L 13/26*** | (2006.01) |
| ***A47L 13/38*** | (2006.01) |
| ***A47L 9/06*** | (2006.01) |
| ***A47L 9/24*** | (2006.01) |

(52) U.S. Cl.

CPC ..... *A47L 9/0693* (2013.01); *A47L 9/0613* (2013.01); *A47L 9/244* (2013.01); *A47L 13/26* (2013.01); *A47L 13/38* (2013.01); *A47L 25/00* (2013.01)

(58) Field of Classification Search

CPC ..... A47L 13/26; A47L 13/38; A47L 25/00; A47L 9/0693

See application file for complete search history.

(56) References Cited

U.S. PATENT DOCUMENTS

| | | | | |
|---|---|---|---|---|
| 5,319,821 A * | 6/1994 | Nicholson | A46B 15/00 | 15/104.8 |
| 7,958,591 B1 * | 6/2011 | Rogers | B25G 1/04 | 15/210.1 |
| 2003/0209263 A1 * | 11/2003 | Bell | A47L 13/22 | 134/187 |

* cited by examiner

*Primary Examiner* — Michael D Jennings
*Assistant Examiner* — Aaron R McConnell
(74) *Attorney, Agent, or Firm* — Steven Rinehart

(57) ABSTRACT

An apparatus for cleaning fan blades of a ceiling fan comprising an L-shaped telescoping member inserted into the distal end of an elongated shaft having a detachable concave tray. In various embodiments, the cleaning apparatus comprises water dispensing means including a hose, nozzle and/or water pump. A concave tray may be detachable. The fibrous material may be detachable.

8 Claims, 3 Drawing Sheets

CEILING FAN CLEANER

FIELD OF THE INVENTION

This invention relates to ceiling fans and more particularly relates to an apparatus for cleaning ceiling fan blades.

BACKGROUND

Description of the Related Art

Ceiling fans with axially rotating blades are well-known in the art, but methods of cleaning the blades and devices for accomplishing the same are not. Typically, ceiling fan blades are positioned overhead at heights of eight to twelve feet—beyond the reach of most homeowners and housekeepers. Circulating air feels cooler than static ambient air because air around the surface of the skin is moved away with circulating air. Inclusion of ceiling fans in residential and commercial structures reduces the costs of heating and cooling the rooms of the buildings which are peopled. Because the fans are usually disposed on the ceiling, it can be laborious to clean dust from the blades of such fans and even trying to clean said blades can be dangerous when ladders are involved.

Because the fan blades are not planar, cleaning their surfaces is all the more difficult using improved devices for the same, such as squeegees.

It is an object of the present invention to remedy these inefficiencies and provide a ceiling fan cleaning apparatus which meets the unmet needs in the art.

SUMMARY

From the foregoing discussion, it should be apparent that a need exists for an improved ceiling fan which overcomes inefficiencies with the prior art, including which reaches to heights and which can be used to dust and wash.

The present invention has been developed in response to the present state of the art, and in particular, in response to the problems and needs in the art that have not yet been fully solved by currently available apparti. Accordingly, the present invention has been developed to provide an improved ceiling fan cleaner comprising: an elongated tubular shaft comprises a plurality of telescoping members; an L-shaped telescoping member insertable into the distal end of the elongated tubular shaft; a polymeric handle heat-pressed onto a proximal end of the shaft; a fibrous, bushy cylindrical component detachably inserted over the L-shaped telescoping member; and a concave tray detachably affixed to the shaft for enveloping the retracted fibrous material adapted to receive cleaning fluid falling from ceiling blade fans.

The concave tray may be detachably affixed in place with a friction fit, using a clamp, to the shaft inferiorly to the fibrous bushy cylindrical component.

The ceiling fan cleaner may further comprise a positive displacement pumping mechanism and two or more check valves adapted to spray water in a substantially lateral direction over the concave tray.

The ceiling fan cleaner, in some embodiments, further comprises a squirt gun.

The ceiling fan cleaner, in some embodiments, further comprises water-dispensing means.

The ceiling fan cleaner may further comprise a water hose.

The water hose may be pressurized in some embodiments.

The fibrous cylindrical component may be fabricated from flexible elastomeric material.

The fibrous cylindrical component may be detachable and interchangeable with other accessories in still further embodiments.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
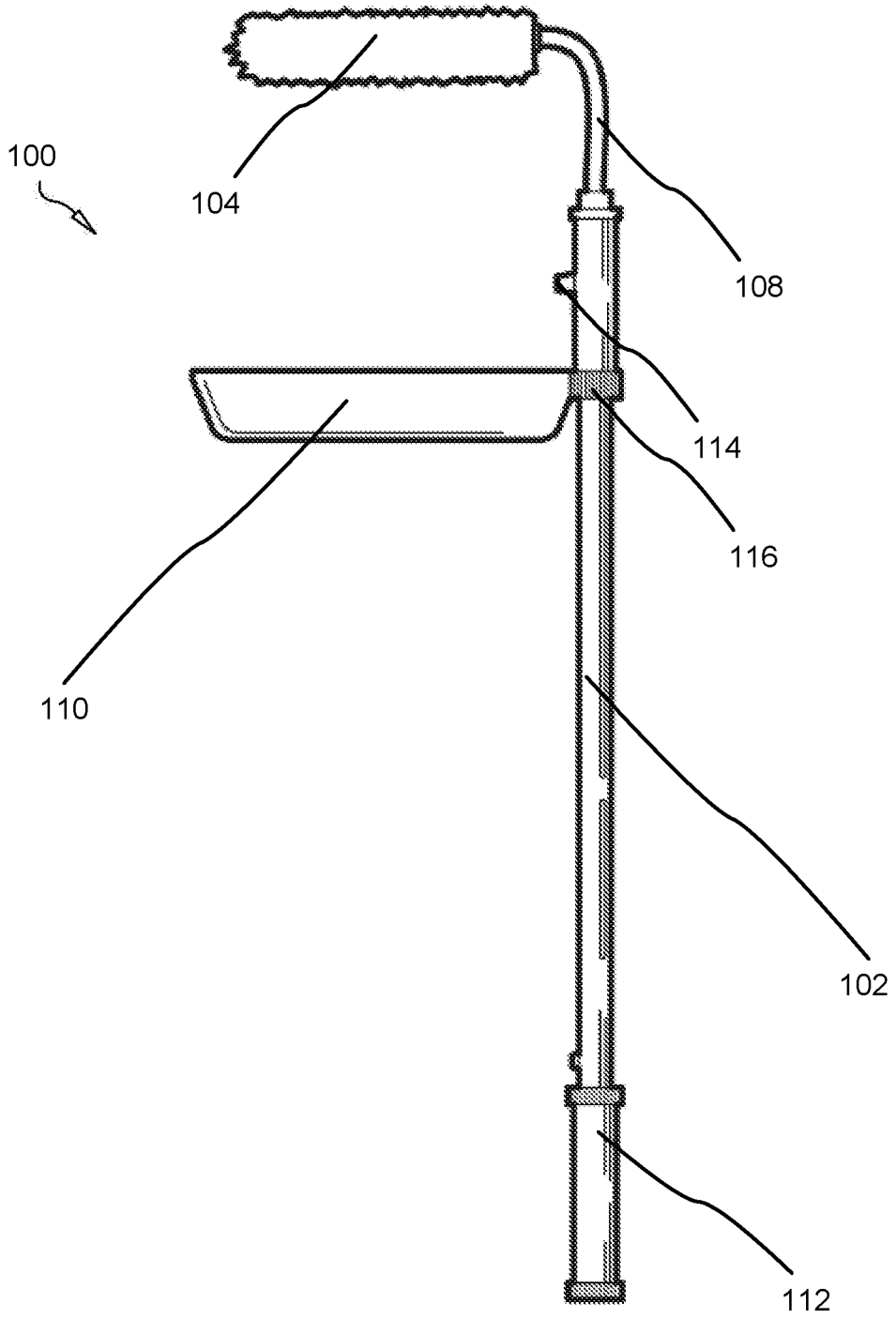
FIG. 1 is a side perspective view of an improved ceiling fan cleaner in accordance with the present invention.

FIG. 1 is a side perspective view of an improved ceiling fan cleaner 100 in accordance with the present invention. The improved ceiling fan cleaner 100 comprises an elongated tubular shaft 102 having a heat-pressed handle 112. A telescoping member 108 inserts into the distal end of the shaft 102 which is L-shaped. The telescoping member 108 is partially enveloped by a fibrous or spongy absorbent material 104 for extracting dust from a fan blade.

In a stowed position, the fibrous material 104 inserts into a tray 110 affixed to the shaft 102 which protects the fibrous material 104 from collecting dust or particulates when stowed. Before use, the L-Shaped distal member 108 is telescopely extracted by hand from the shaft 102 and positioned at a distance predetermined from the concave tray 110 to allow a fan blade to position between the fibrous material and the concave tray 110. In some embodiments, the shaft 102 comprises a plurality of telescoping members which join inferiorly to the concave tray 110. In these embodiments, the fibrous material 104 may be manually adjusted in the hands a user holding the implement 100 high to collapse upon the concave tray 110.

The fibrous material 104 comprises an accessory, or implement, having a hollow interior recess for receiving the telescoping L-shaped member 108 and one open end for feeding the distal L-shaped telescoping member 108 through. In various embodiments, alternate or additional accessories are included in the apparatus 100 or assembly, including alternatively-shaped fibrous materials 104, squeegees, sponges, rollers and the like. In some embodiments, the fibrous material 104 rotates axially about the L-shaped member 108. The fibrous material 104 may be configured to rotate axially using electromechanical means as known to those of skill in the art.

In the shown embodiment, the fibrous material 104 is flexible and may comprise a cylindrical or tubular inner component for receiving the telescoping member 108. In various other embodiments, the fibrous material 104 is rigid and inflexible. In some embodiments, the distal end of the telescoping member 108 may be flexible to varying degrees and may twist, torque, or contort axially to contour an upper surface of a fan blade.

The tray 110 (or concave tray 110) may likewise be flexible or rigid. The tray 110 is detachable in various embodiments to the shaft 102 using means known to those of skill in the art including a clamp 116 forming a friction fit with the shaft 102. The tray 110 may be bendable.

The shaft 102 may comprise a nozzle 114 for spraying a fluid such as water or cleaning fluid upon a fan blade disposed between the fibrous material 104 and the concave tray 110.

Figure 2:
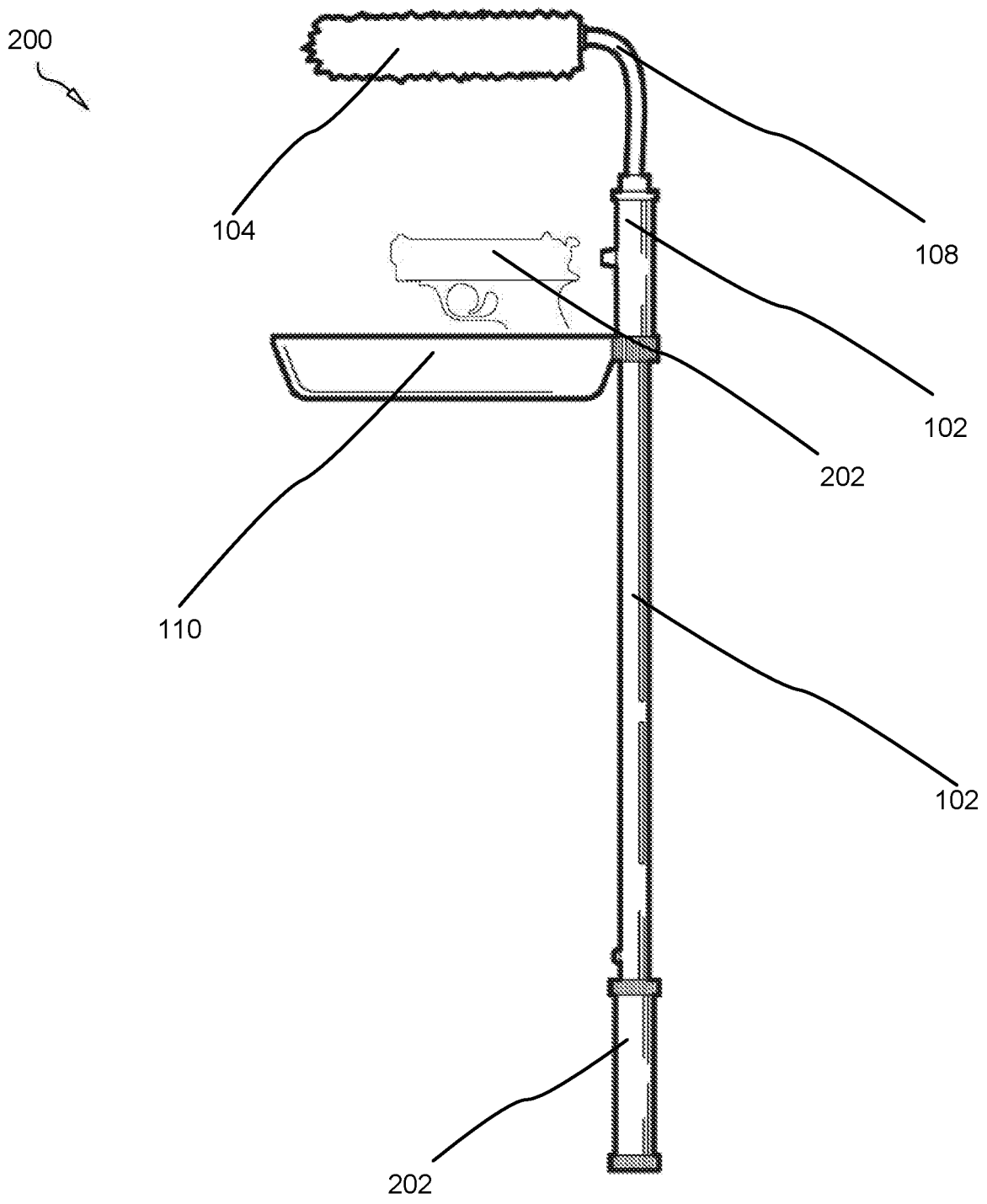
FIG. 2 is a side perspective view of a ceiling fan cleaner in accordance with the present invention.

FIG. 2 is a side perspective view of a ceiling fan cleaner 200 in accordance with the present invention.

The ceiling fan cleaner 200 may comprise a squirt gun 202, water bottle, or any mechanism comprising a positive displacement pumping mechanism and two or more check valves adapted to spray fluid in a substantially lateral direction over the concave tray.

The handle 202 may house a reservoir for holding water or cleaning fluid.

Figure 3:
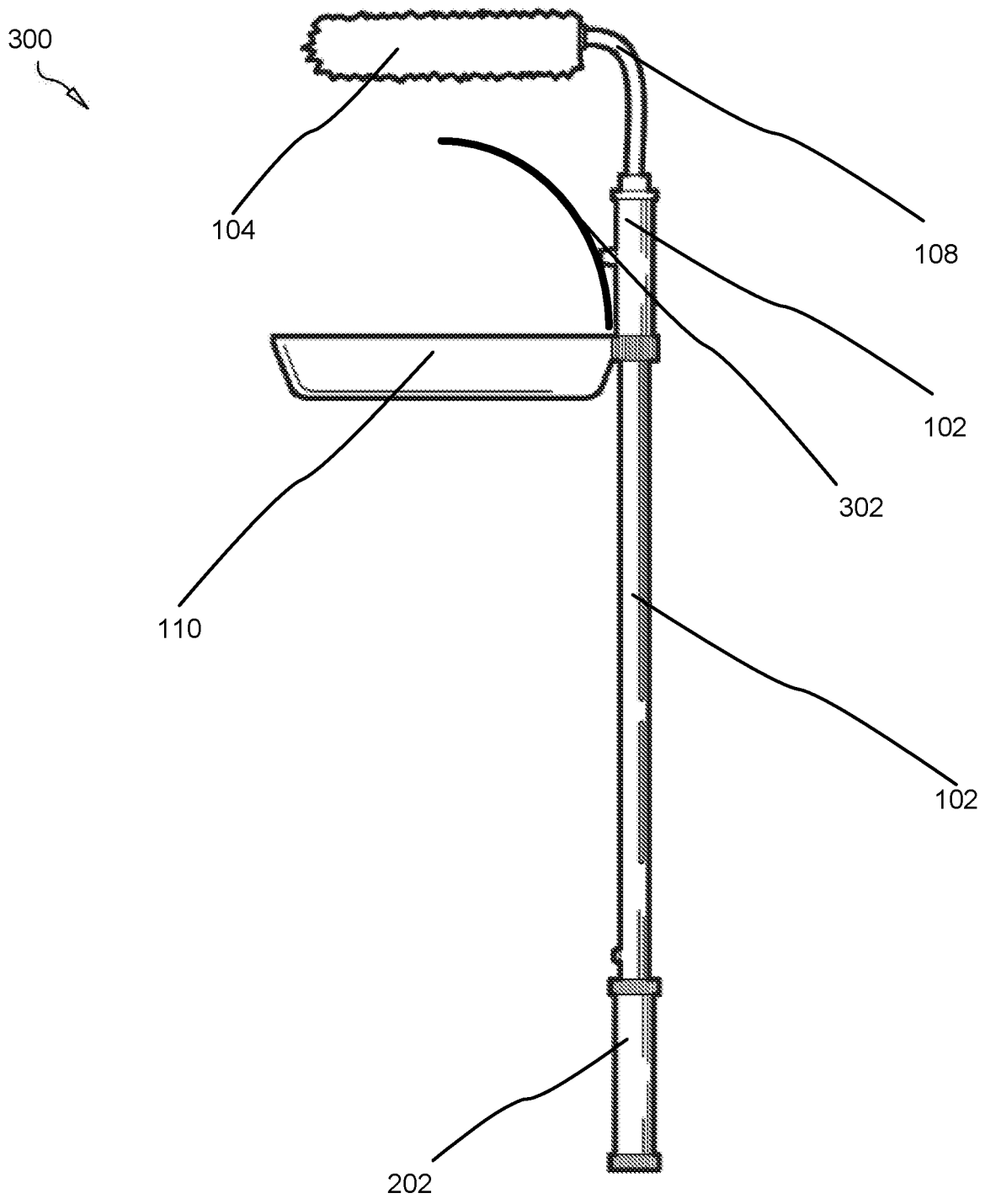
FIG. 3 is a side perspective view of another embodiment of a ceiling fan cleaner in accordance with the present invention.

FIG. 3 is a side perspective view of another embodiment of a ceiling fan cleaner 300 in accordance with the present invention.

The ceiling fan cleaner 300 may comprise alternate water-dispensing means including a flexible polymeric hose 302, nozzle and/or water pump. The water hose 302 may be pressurized and adapted to dispense through nozzles in the tray and/or through nozzles affixed to or in other components of the apparatus 100.

The water house 302 may span the majority longitudinal length of the elongate shaft 102 interiorly to the shaft within a hollow interior recess. The shaft 102 may be tubular defining said recess. The water hose may likewise span the shaft 102 exteriorly. In these embodiments, the water hose is pressurized using a manually-activated or electromechanically-activated pump disposed inferiorly to the concave tray 110 on the shaft 102.

In various embodiments, the horizontally jutting portion of the telescoping member 108 is hingedly affixed. The L-shaped component 108 may be hingedly affixed to the shaft 102.

What is claimed is:

1. An improved ceiling fan cleaner comprising:

an elongated tubular shaft comprises a plurality of telescoping members;

an L-shaped telescoping member insertable into the distal end of the elongated tubular shaft;

a polymeric handle heat-pressed onto a proximal end of the shaft;

a squirt gun;

a fibrous, bushy cylindrical component detachably inserted over the L-shaped telescoping member; and a concave tray detachably affixed to the shaft for enveloping the retracted fibrous material adapted to receive cleaning fluid falling from ceiling blade fans.

2. The ceiling fan cleaner of claim 1, wherein the concave tray is detachably affixed in place with a friction fit, using a clamp, to the shaft inferiorly to the fibrous bushy cylindrical component.

3. The ceiling fan cleaner of claim 1, further comprising a positive displacement pumping mechanism and two or more check valves adapted to spray water in a substantially lateral direction over the concave tray.

4. The ceiling fan cleaner of claim 1, further comprising water-dispensing means.

5. The ceiling fan cleaner of claim 1, further comprising a water hose.

6. The ceiling fan cleaner of claim 1, wherein the water hose is pressurized.

7. The ceiling fan cleaner of claim 1, wherein the fibrous cylindrical component is fabricated from flexible elastomeric material.

8. The ceiling fan cleaner of claim 1, wherein the fibrous cylindrical component is detachable and interchangeable with other accessories.

* * * * *